US007789234B2

(12) United States Patent
Clark

(10) Patent No.: US 7,789,234 B2
(45) Date of Patent: Sep. 7, 2010

(54) DISPLAY PACKAGE FOR SCISSORS

(76) Inventor: Wayne Clark, 68 Leveroni Ct., Suite 200, Novato, CA (US) 94949

( * ) Notice: Subject to any disclaimer, the term of this patent is extended or adjusted under 35 U.S.C. 154(b) by 493 days.

(21) Appl. No.: 11/672,886

(22) Filed: Feb. 8, 2007

(65) Prior Publication Data

US 2008/0190796 A1 Aug. 14, 2008

(51) Int. Cl.
*B65D 73/00* (2006.01)
*A45C 11/26* (2006.01)

(52) U.S. Cl. ..... 206/461; 206/467; 206/349

(58) Field of Classification Search ..... 206/461–471, 206/349, 472–483
See application file for complete search history.

(56) References Cited

U.S. PATENT DOCUMENTS

| | | | | | |
|---|---|---|---|---|---|
| 2,684,758 | A | * | 7/1954 | Aquino | 206/349 |
| 3,307,686 | A | * | 3/1967 | Brecher | 206/232 |
| 4,142,632 | A | * | 3/1979 | Sandel | 206/363 |
| 4,165,805 | A | * | 8/1979 | Fethke et al. | 206/349 |
| 4,179,029 | A | * | 12/1979 | Fethke et al. | 206/349 |
| 4,385,692 | A | * | 5/1983 | Eldridge, Jr. | 206/363 |
| 4,506,787 | A | * | 3/1985 | Bruso | 206/363 |
| 4,511,035 | A | * | 4/1985 | Alpern | 206/363 |
| 4,714,159 | A | * | 12/1987 | Linden | 206/349 |
| 5,234,106 | A | * | 8/1993 | Transue et al. | 206/363 |
| D354,910 | S | * | 1/1995 | Weatherford et al. | D9/415 |
| D359,678 | S | * | 6/1995 | Weatherford et al. | D9/415 |
| 5,435,447 | A | * | 7/1995 | Weatherford et al. | 206/349 |
| 5,601,189 | A | * | 2/1997 | Roshdy | 206/363 |
| 2006/0113205 | A1 | * | 6/2006 | Liu | 206/349 |
| 2009/0065386 | A1 | * | 3/2009 | Hasegawa | 206/349 |

* cited by examiner

*Primary Examiner*—J. Gregory Pickett
*Assistant Examiner*—Jose S Stephens, III
(74) *Attorney, Agent, or Firm*—Joseph L. Strabala

(57) ABSTRACT

A display package for scissors consists of an elongated, generally flat member having a top and bottom end, a raised hollow pedestal means mounted adjacent to said bottom end of said member, the pedestal means having a top portion with means operable to secure a finger ring of a pair scissors thereto and support the scissors horizontally above the card with arch means located adjacent to said top end of said member operable to restrain the swing of at least one of the blades of a pair of scissors mounted on the top portion of the pedestal when the handles of such scissors are manipulated by a customer. It is preferred that the top of the pastel include means for rotation of the connection with the scissors so that a greater range of manipulation is available to a prospective customer. In addition the card can include a clear cover if desired.

3 Claims, 3 Drawing Sheets

DISPLAY PACKAGE FOR SCISSORS

BACKGROUND

The present invention relates to an improved package for displaying scissors in a manner which permits manipulation of the scissors by a prospective purchaser at the point of sale without removing the scissors from the package.

In general beauticians and other professional who use scissors in their work have definite likes and dislikes regarding the feel, balance and operation of such implements.

In the past the scissors were fastened to the card in some manner such as by staples or wire loops or clips which was not very satisfactory especially for high quality scissors. A better method of displaying scissors is to enclose them in a transparent plastic blister on card package which envelopes the tool and is provided with eyelets or apertures for placing the package of the hooks on a display rack. Typically in such blister packages it is customary to enclosed scissors within a formed blister made of transparent, stiff, flexible material such as polyvinyl chloride (PVC) and applied to a display card by heat and/or adhesive means so the customer can view the scissors. As these known blisters completely enclose the scissors, and it is impossible for the purchaser to touch or test the article without opening the blister covering.

Better point of sale blister packaging have been developed for scissors see e.g., U.S. Pat. No. 4,165,805 which discloses a blister on card type package for a scissors in which the blister is generally shaped to conform to the shape of the tool. A cut-out portion in the blister permits the one handle of the scissors to be accessed and manipulated and/or tested by a prospective purchaser. However, such conventional blisters on card packages of this type do not permit total visibility of the packaged article, in that the card obstructs one side thereof.

U.S. Pat. No. 5,279,417 issued to Seaton discloses a molded blister type package which permits substantial visibility of a packaged article, while also providing an opening through which a portion of the packaged article may extend for manipulation by a prospective purchaser.

A disadvantage of conventional form-fitting blister packages is that scissors packaged with cut outs for one of the handles therein occurs due to the lubricated pivot areas which can bleed lubricant onto the interior surface of the transparent plastic package, causing an unsightly condition. Heating of the package will cause it to retain heat due to the lack of circulation under the blister, accelerating lubricant bleeding.

This problem of lubrication soil also effects clamshell type blister package for holding and displaying pliers and similar hand tools which encloses the upper portion of the tool while allowing the handles to extend through a lower end thereof. This configuration enables a prospective customer to manipulate the handles to some degree to provide an indication of the operational characteristics of the tool. While such arrangements allow all aspects of tools so packaged to be visible through the package it is restricted to tools that have enlarged heads which can be retained due to the size of the head, whereby the packaging is not suitable for scissors, see e.g., U.S. Pat. No. 4,872,551 issued to Theros.

SUMMARY OF THE INVENTION

A novel display package for scissors includes an elongated, generally flat member having a top and bottom end, a hollow raised pedestal means mounted adjacent to one said end of said member to project above the surface, the pedestal means including means operable to attach a finger ring of a pair scissors to the top of the pedestal to suspend the scissors above the member from the pedestal, and arch means located adjacent to the opposite end of the member operable to restrain the blades of a pair of scissors having its finger ring mounted on said top portion of the pedestal to a limited arc when scissors mounted by the pedestal are manipulated by an interested customer. In the preferred embodiment the top of the pedestal is capable of rotation whereby a wider range of opening and closing the scissors is available.

BRIEF DESCRIPTION OF THE DRAWINGS

The invention will be better understood by referring to the attached drawing wherein:

FIG. 1 is front view of a prior art blister package for scissors and the like;

DESCRIPTION OF A PREFERRED EMBODIMENT

Figure 1:
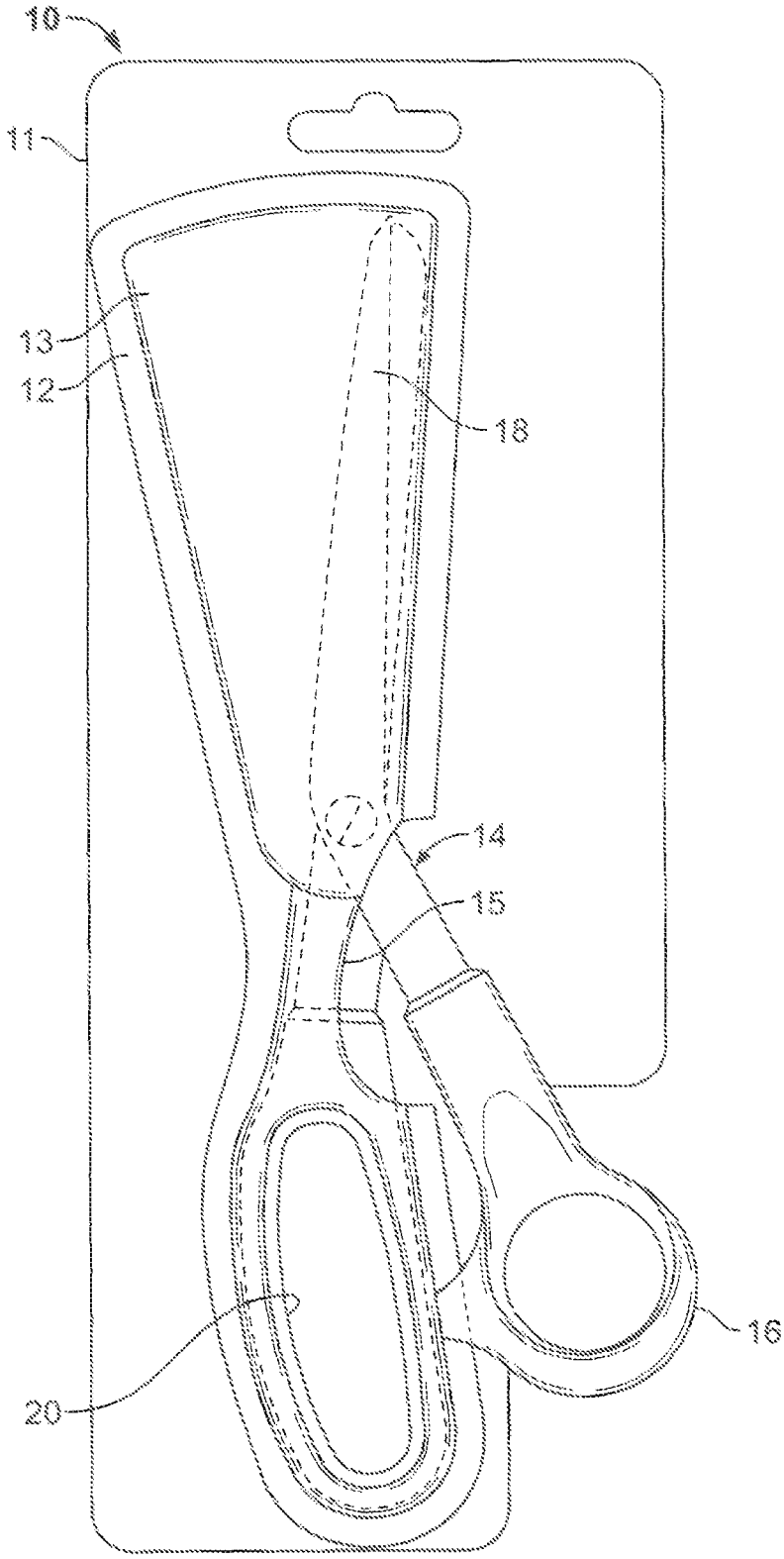
FIG. 1 (Prior Art)

The packaging shown in FIG. 1, a prior art blister package 10 for scissors and the like, is helpful to marketing such products especially as the price point increase. When a customer can actually manipulate the product to get a personal feel for the balance and operation of the device it is more likely he/she will purchase. The more restricted of the customer's access to the scissors, in this case, in the package, the greater his/her reluctance to purchase. As can be appreciate from FIG. 1 the access of the customer is restricted, though not as much as if the entire pair of scissors in under a blister covering.

This patented prior art packaging has a display card 11 which has a preformed blister covering 12 adhesively adhered to its surface. The preformed blister covering includes recess 13 for receiving a pair of scissors 14 with an opening 15 in the blister cover for one of the handles 16 to extend outside of the blister covering with the other handle secured under the blister covering. The recess is enlarged where it covers the blades 18 of the scissors, allowing the ends of the blades to open and close when the handle thereof outside the blister covering is swung toward and way from the handle which is secured.

As can be appreciated this arrangement allows only limited access to the scissors, which is further restricted by the bulk of the packaging even though a prospective customer may insert his finger(s) in to an aperture 20 which passes through an opening aligned with the aperture in the secured handle.

Figure 2:
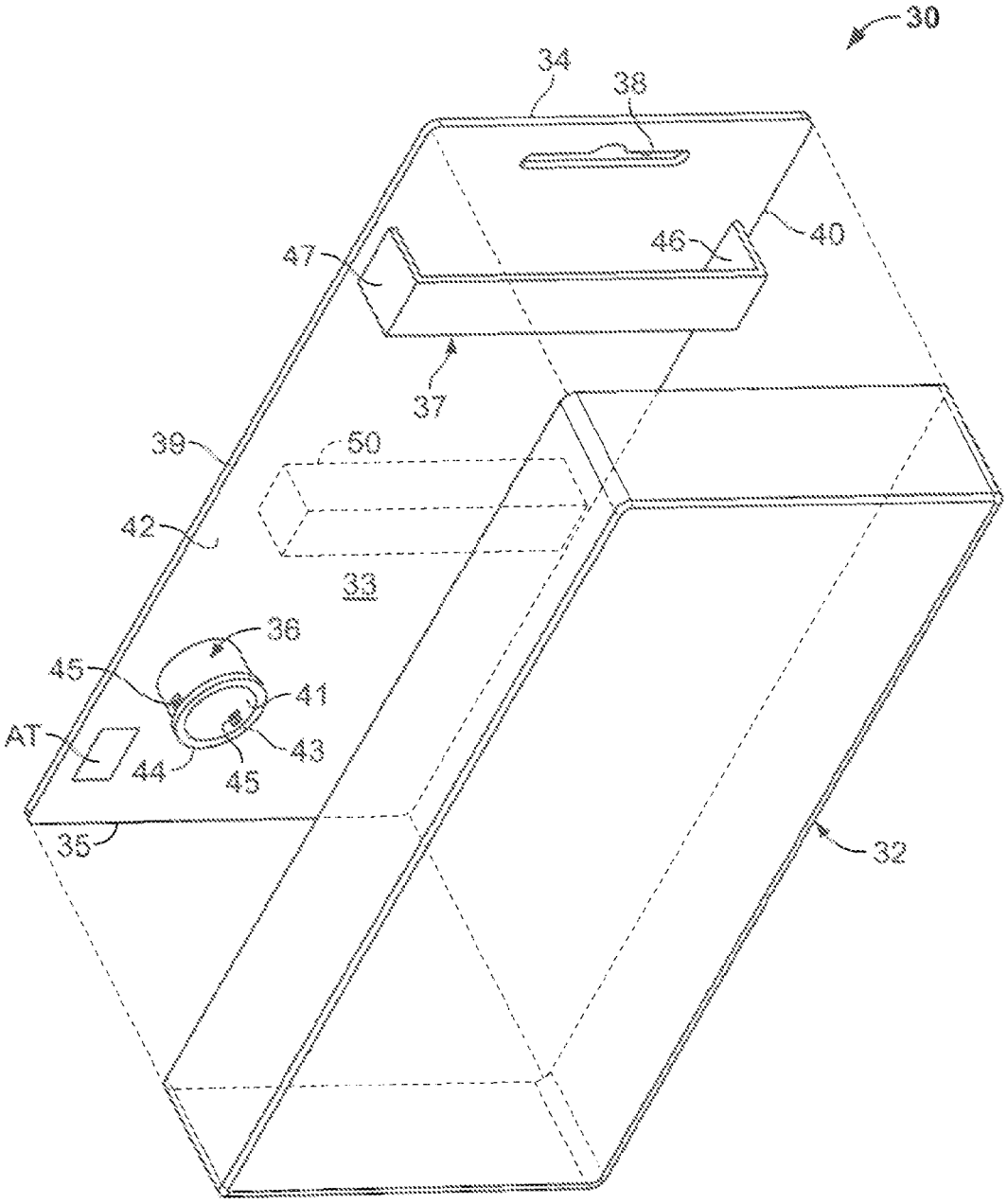
FIG. 2 is a perspective of the novel display package with the optional cover exploded therefrom.

In contrast the novel display package 30 illustrated in FIG. 2 for scissors (not shown in this figure) provides much greater and more unrestricted access to the scissors displayed in the package. In FIG. 2 the novel display package is illustrated with its option cover 32 exploded therefrom.

The novel display package 30 includes three distinct components, a flat elongated member 33 [or card] having a top end 34 and a bottom end 35, a hollow raised pedestal 36 which is mounted adjacent to the bottom end of the member and an arch 37 located adjacent to the top end of the member and secured there.

Typically this member 33 is formed of rigid or simi-rigid plastic having hollows cores to reduce its weight without sacrificing strength. It is generally rectangular with an eyelet 38 located at its top end 34 by which the display packaged can be hung on a display rack.

Adjacent to the bottom end 35 of the member the raised pedestal 36 is mounted. This pedestal can be located in the center or adjacent to the left 39 or right side 40 of the member Pedestal 36 is preferably cylindrical with a central aperture 41 and is mounted so its cylindrical axis is normal to the surface 42 of the member 33. The central aperture allows a customers thumb to be inserted in to the pedestal. At the top 43 of the pedestal a circular rim 44 is formed that provides additional support for a finger ring of a pair of scissors which is mounted on the pedestal when the novel display package 30 is placed in service as described later. Near the top of the pedestal are devices to hold the forgoing finger ring tightly on the top of the pedestal. Scissors can be attached by apertures 45 just under the rim through which plastic ties can be threaded or in the alternative a tubular cap with a top circular flange (not shown) that can be pushed into aperture 41 and locked (glued) therein to sandwich a finger ring between the rim and the flange. The base of the pedestal is secured in the member in manner so it can support (suspend) a pair scissors that has its right finger ring secured to the pedestal in a parallel relationship with and above the surface 42 of the member. In one alternative embodiment (not shown) the top of the pedestal is connected to the pedestal in a manner that it can rotate about the cylindrical axis of the pedestal to reduce the interference from the display package when the scissors are manipulated. As indicated the pedestal can be located anywhere at the bottom of the member; thus the novel display can be used for left handed scissors by placing the pedestal toward the left side of the member and securing the left finger ring of the scissors to the top of the pedestal as previously described.

Adjacent to the top end 34 of the member 33 the arch 37 is secured to the member with the height of the arch sufficiently above the surface 42 so that the blades of a pair of scissors with its finger ring mounted on the pedestal 36 will pass under the arch. The sides 46 and 47 of the arch which are secured to the member form stops that limit the arc the ends of the blades can travel when a customer manipulates the scissors.

If desired a support bar 50 illustrated in phantom lines, between the pedestal 36 and the arch 37, can be added to aid in the support of a pair of scissors that has one of its finger rings secured to the pedestal.

Figure 4:
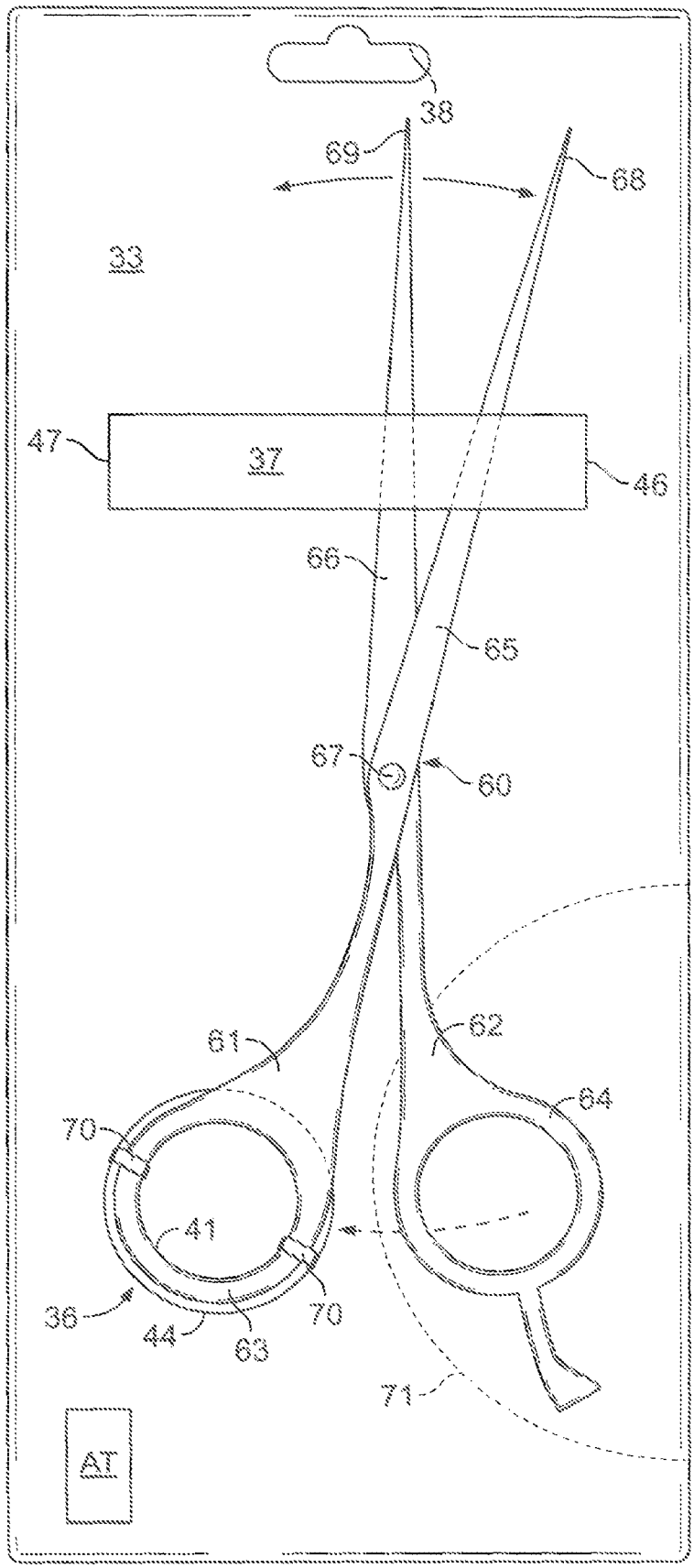
FIG. 4 is a plan view of the novel display package with a pair of scissors mounted in the package.

In FIG. 4 a pair of scissors 60 is shown attached to the novel display package 30 which is typical of scissor products of the types that can be displayed with the package. The scissors include a pair of handles 61 and 62 each terminating in a finger ring 63 and 64, respectively at their distal ends. Handle 61 is connected to its blade 65 while handle 62 is connected to its blade 66. At the intersection of the handles with the blades, a pivot 67 joins the two parts so that manipulation of the handles will cause the ends of the blades 68 and 69, respectively, to open and close.

As can be seen in FIG. 4 finger ring 63 is attached to the top 43 of the pedestal 36 so it abuts against rim 44 by two or more permanent ties 70 which hold this finger ring tightly against surface of the rim. Before the finger ring is secured to the rim the blades 66 and 67 are slid under the arch 37. As a result when the finger ring 63 is drawn tightly against the rim, the scissors will be suspended above the surface 42 of the member 33 of the display package with the blades passing under the arch so the movement of its blade 69 will be restrained by the arch. For convenience the arch can be designed so that it can be opened to accommodate placing the blades under the arch after the finger ring is attached to the rim. Moreover if the top of the pedestal, includes a journal allowing the rim to rotate, both blades will swing under the arch until they hit the stops formed by the arch, as can be appreciated by viewing FIG. 4, when a customer manipulates the scissors.

Referring to FIG. 4 it can be seen the novel display package allows finger ring 64 of the scissors 60 to freely swing along the arc defined by broken line A so that a customer can check the feel and operation of the scissor and inspect the entire surfaces (top and bottom) of the scissors. If desired the member 33 can include a cut out defined by phantom line 71 to reduce any obstruction from the member to the manipulation of the scissors by a customer.

Thus, the package of the invention provides an attractive presentation of scissors providing unobstructed access in a manner that the handles are substantially free to be manipulated by the prospective purchaser at the point of sale. Yet the novel display package prevents pilferage by firmly attaching the scissors to the display package having a anti-theft chip AT thereon.

Figure 3:
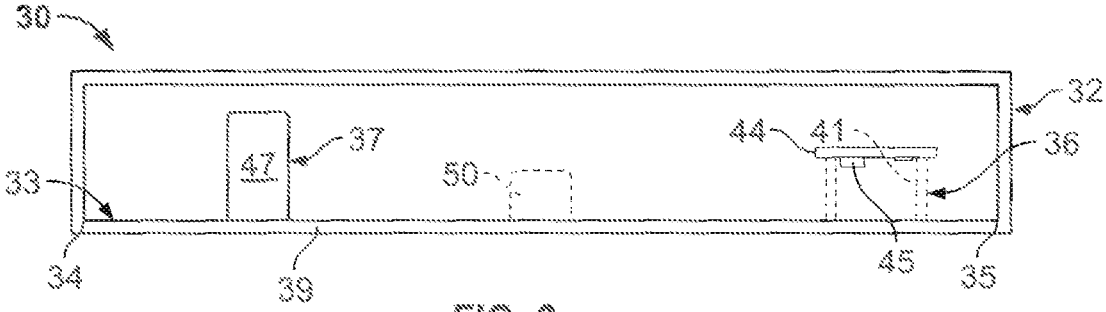
FIG. 3 is an elevation of the novel display package with the optional cover thereon.

The optional rectangular cover 31, shown in FIGS. 2 and 3, is used primarily for shipping and handling prior to placing the novel display package on a rack prior to such the cover will be removed.

While a particular embodiment of the package of the invention has been shown and described, it will be appreciated by those skilled in the art that changes and modifications may be made thereto without departing from the invention in its broader aspects and as set forth in the following claims.

The invention claimed is:

1. A display package for scissors allowing the articulation of blades of said scissors without removing said scissors from said display package comprising:

an elongated, generally flat member having a top and bottom end;

a raised hollow pedestal mounted adjacent to said bottom end of said member, said pedestal having a top portion with at least one aperture, said top portion having a journal connecting said top portion to said pedestal so said top portion can rotate;

at least one attachment tie threaded through said at least one aperture securing a finger ring of said scissors to said top portion such that said scissors are suspended above a face of said flat member; and an arch attached to said flat member and adjacent to said top end of said flat member, said arch allowing said blades of said of scissors passing thereunder, which has one of said finger rings of said scissors mounted on said top portion of said pedestal to open and close to when said scissors are manipulated while in said display package by a customer.

2. The display package of claim 1 wherein a removable cover is provided for the member for shipping and handling of the package.

3. The display package of claim 1 wherein the member has a cut out along one side to enable greater physical access a handle of a pair the scissors mounted thereon.

* * * * *